United States Patent [19]

Lattion

[11] Patent Number: 4,781,338

[45] Date of Patent: Nov. 1, 1988

[54] BOBBIN TUBE SUPPORT

[75] Inventor: Andre Lattion, Seuzach, Switzerland

[73] Assignee: Rieter Machine Works, Ltd., Winterthur, Switzerland

[21] Appl. No.: 73,810

[22] Filed: Jul. 15, 1987

[30] Foreign Application Priority Data

Jul. 18, 1986 [GB] United Kingdom ..... 8617614

[51] Int. Cl.[4] ..... B65H 49/14; B65H 49/04

[52] U.S. Cl. ..... 242/131; 242/35.5 A; 242/129.71; 242/130

[58] Field of Search ..... 242/131, 131.1, 130, 242/130.1, 130.4, 129.5, 129.7, 129.71, 35.5 A, 130.3

[56] References Cited

U.S. PATENT DOCUMENTS

| | | | |
|---|---|---|---|
| 1,233,064 | 7/1917 | Kretzschmar | 242/130 |
| 1,805,495 | 5/1931 | McKean | 242/130 X |
| 1,966,247 | 7/1934 | Janssen . | |
| 1,991,699 | 2/1935 | Reiners et al. . | |
| 2,466,861 | 4/1949 | Peterson . | |
| 2,505,427 | 4/1950 | Peterson . | |
| 2,738,139 | 3/1956 | Williams et al. | 242/130 |
| 3,409,141 | 11/1968 | Cunningham, Jr. et al. . | |
| 3,580,524 | 5/1971 | Weaver | 242/130 X |
| 4,073,450 | 2/1978 | Carlsson et al. | 242/131 |
| 4,641,740 | 2/1987 | Grecksch et al. | 242/35.5 A X |
| 4,655,665 | 4/1987 | Lattion | 242/35.5 A X |

FOREIGN PATENT DOCUMENTS

| | | | |
|---|---|---|---|
| 2655487 | 6/1978 | Fed. Rep. of Germany . | |
| 606892 | 3/1926 | France | 242/129.7 |
| 1304615 | 8/1962 | France . | |
| 884111 | 12/1961 | United Kingdom . | |
| 976437 | 11/1964 | United Kingdom . | |
| 1049701 | 11/1966 | United Kingdom . | |

*Primary Examiner*—Stanley N. Gilreath
*Attorney, Agent, or Firm*—Kenyon & Kenyon

[57] ABSTRACT

A one piece supporting element has a pair of elongated strips to engage within a bobbin tube with a force sufficient to prevent dropping off of the tube during conveyance through a vertically dependent position. The supporting element is mounted in cantilever fashion via a cross-piece at the proximal end which fits into a recess of a carrier on a conveyor.

15 Claims, 3 Drawing Sheets

Figure 3A:
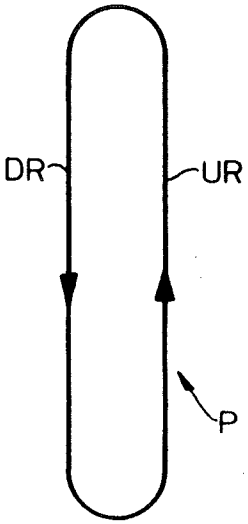

Fig. 1
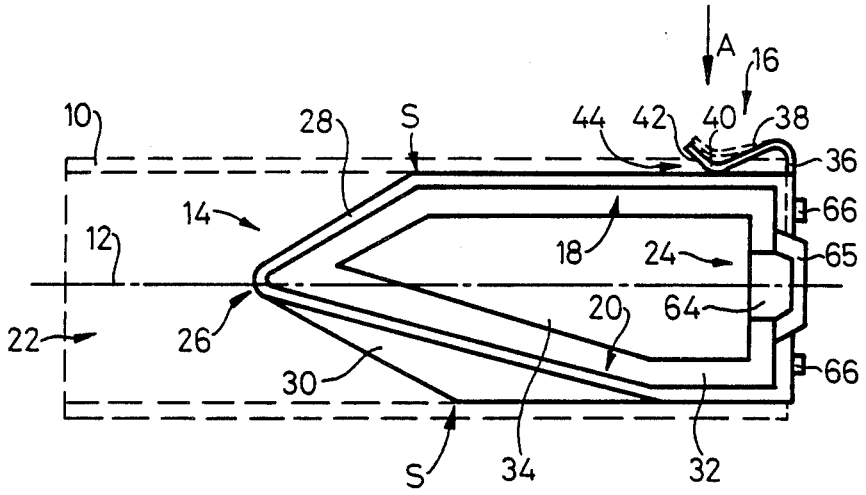
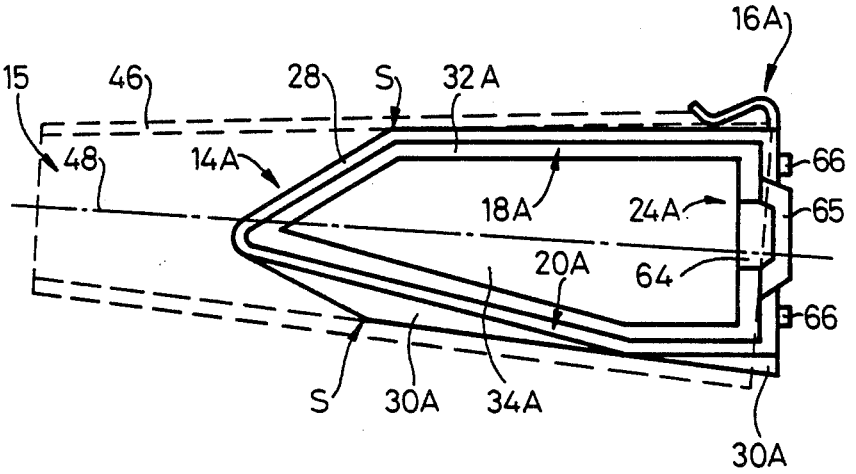
Fig. 2

BOBBIN TUBE SUPPORT

The present invention relates to a bobbin tube support and to creels or magazines for textile machines including such tube supports. More particularly, this invention relates to bobbin tube supporting elements.

U.S. Pat. No. 4,655,665 describes a bobbin magazine specifically designed for conical bobbins. The design concept calls for telescoping of the tube to "sticks" which are carried in respective pockets on an endless conveying path. The system works adequately within its own limitations, but remains unsatisfactory firstly because another design is needed to handle cylindrical bobbin tubes and secondly because telescoped conical bobbin tubes having small angles of tapes are relatively difficult to separate cleanly.

U.S. Pat. No. 4,641,740 describes a magazine for conical bobbin tubes, designed particularly for use with a starter-bobbin winding unit of a rotor spinning machine, cop backwinding (rewinding) machine or other yarn package forming machine. The magazine comprises an endless conveyer, arranged to travel on an elongated, closed path, extending substantially vertically. The conveyer carries a plurality of pegs projecting at right angles to the conveying direction, and each adapted to receive a respective, individual bobbin tube. A curved guide-plate is located adjacent the lower end of the conveyer, and the tubes slide on this curved plate as they are transferred from the downward vertical run to the upward vertical run of the conveyer. The pegs remain within the respective, associated tubes and cause the sliding movement along the guide plate, but they do not support the tubes during this movement.

The tube magazine, shown in U.S. Pat. No. 4,641,740, employes a handling concept which is known from handling of cops doffed from a ring spinning machine, e.g. as shown in German published Patent Application No. 22 25 673. In accordance with this concept, the bobbin tubes (or cops) are handled as individuals rather than in bulk. This enables careful treatment of each transported article (cop or bobbin tube) at all states of the handling operation. In view of steadily increasing demands in the textile industry, this concept is basically correct. Furthermore, no distinction is needed between conical and cylindrical tubes.

However, the details of the magazine construction shown in U.S. Pat. No. 4,641,740 stand in partial contradiction to the basic concept underlying the design. In particular, the bobbin tubes are not accurately retained relative to the support pegs at any time during storage within the magazine, and the tubes actually fall away from the support pegs at the lower end of the conveyer in order to be dragged along the curved bottom plate of the magazine housing.

Accordingly, it is an object of the invention to provide a bobbin tube support which cooperates directly with a bobbin tube.

It is another object of the invention to provide a bobbin tube supporting element which permits ready removal of a bobbin when desired.

It is another object of the invention to be able to convey and support a series of bobbins in an endless path in a simple reliable retained manner.

It is another object of the invention to be able to support individual bobbin tubes in a creel or magazine in a simple secure manner.

Briefly, the invention provides a bobbin tube supporting element which has at least a pair of elongated portions for contacting an interior of a bobbin tube at angularly spaced apart locations and a mounting part in the form of a cross-piece connecting the portions at the proximal ends for mounting of the elongated portions from a carrier in cantilever-fashion. A guide part connects the portions at the distal ends for guiding of a bobbin tube onto the elongated portions.

The elongated portions are sized to contact a bobbin tube to maintain the tube on a predetermined axis. In addition, the elongated portions serve to prevent relative radial movement between the tube and the portions thereat.

The supporting element is of light weight one-piece construction and cooperates with a retaining element which extends over one of the elongated portions to apply a clamping force on a bobbin tube located between the retaining element and supporting element for releasably retaining the tube against axial movement from the supporting element.

The invention also provides a carrier on which a plurality of tube supporting elements can be mounted in parallel cantilever-fashion. The carrier may also have one or more retaining elements to hold the bobbin tubes on the respective supporting elements.

In the preferred embodiment, the support forms two contact zones within the interior of the tube, spaced approximately 180° around the tube axis. There could, for example, be more such contact zones (with reduced angular spacings), but the use of an increased number of contact zones increases the cost and complexity of the element.

The support also preferably contacts the interior of the tube at positions spaced axially thereon so as to maintain the tube axis on a substantially predetermined alignment relative to the support. Thus, each contact zone referred to above may be in the form of an elongated strip extending over about $\frac{1}{3}$ to $\frac{1}{2}$ the axial length of the tube. Each strip is preferably parallel to the tube axis, but this is not essential.

Where a plurality of spaced contact zones is required, the support may comprise a corresponding number of elongated portions forming respective contact zones. The portions are preferably joined at least at one end by a guide part adapted to guide a tube onto said portions. The portions may also be joined at the other end by a mounting part adapted to be secured to the carrier. Portions joined at one or both ends form a tube engaging element which is preferably rigid.

The retaining element may be integral with or formed separately from another part of the tube support, e.g. the tube engaging element. The latter may, e.g., be made of a synthetic plastics material, while the retaining element may be made of metal.

The retaining element may be adapted to engage the internal or external peripheral surface of a tube on the support. In the latter, preferred case, the retaining element functions as a clamping element to apply a clamping force between itself and a contact location within the tube.

The carrier may carry a plurality of tube supports and may itself be adapted to be mounted in a creel or magazine. The supports may have individual, respective clamp elements, or one clamp element may be provided with an associated group of support elements. In the preferred embodiment, the carrier is part of an endless conveyor member, adapted to move the tube supports around a closed path with a direction of travel at right angles to the axes of bobbin tubes on the supports.

The tube supporting element is intended particularly, but not exclusively, for use in a bobbin tube magazine for use in cooperation with or attached to a travelling service tender for performing service operations on a textile machine. Further details of an arrangement specifically designed for this purpose can be found from in copending U.S. patent application Ser. No. 074,985, filed July 17, 1987. The full disclosure of that application is incorporated in the present specification by reference.

Figure 3:
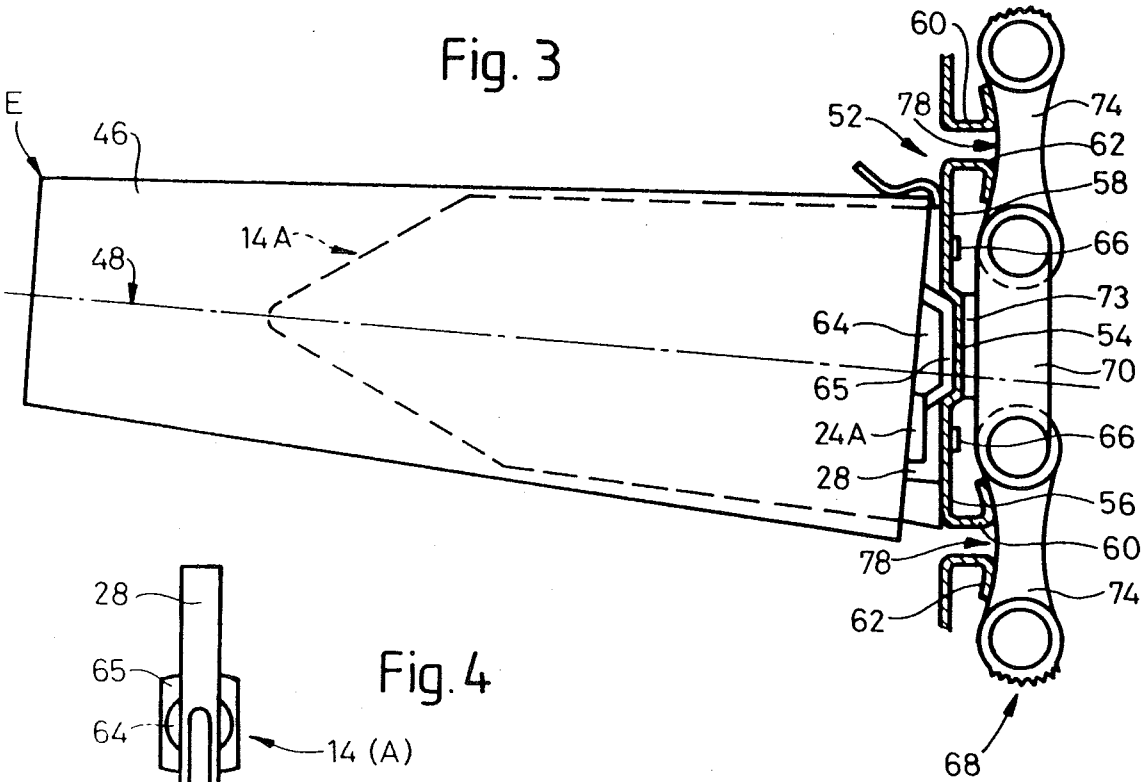
Figure 4:
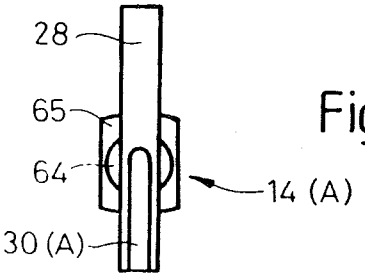
Figure 6:
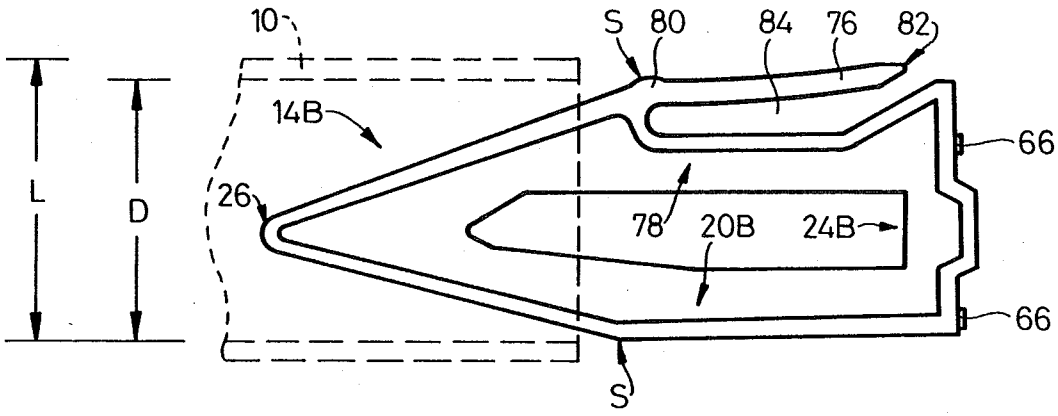
Figure 5:
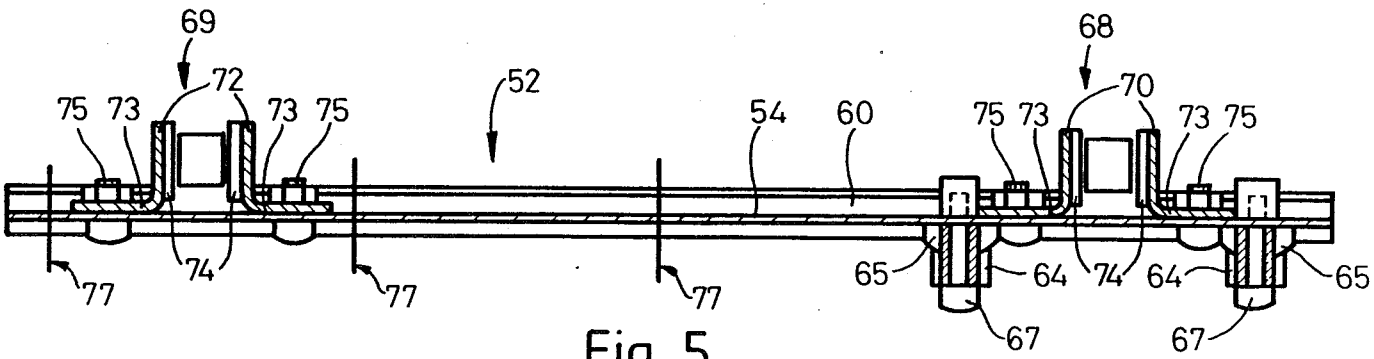

By way of example, embodiments of the present invention will now be disclosed in further detail with reference to the accompanying drawings, in which:

FIG. 1 is a side-elevation of a tube support in accordance with the invention for supporting cylindrical bobbin tubes, FIG. 2 is a similar view of a tube support in accordance with the invention for supporting conical bobbin tubes, FIG. 3 is a side view of a tube support mounted on a chain conveyor, FIG. 3A is a diagramatic view of the chain conveyor, FIG. 4 is a plan view, drawn to approximately the same scale as the elevations of FIGS. 1–3, in order to indicate approximately the relative dimensions of the tube supports in plan and in elevation, FIG. 5 is a diagrammatic plan view of the carrier of FIG. 3 and its connection with the chain conveyor, and FIG. 6 is a view similar to FIG. 1 but showing an alternative embodiment in accordance with the invention.

In FIG. 1, the dotted lines represent a longitudinally sectioned illustration of a cylindrical bobbin tube 10 having a longitudinal axis represented by the chain-dotted line 12. The tube is supported and releasably retained by a bobbin tube support comprising a tube engaging or supporting element 14 and a clamping or retaining element 16 which is indicated in full lines in a disposition prior to mounting of a tube 10 on the supporting element 14, and in dotted lines in a disposition following such mounting.

Supporting element 14 comprises a pair of elongated strip-like elements 18, 20 which engage the internal surface 22 of the bobbin tube 10 at positions spaced angularly through approximately 180° relative to the tube axis 12. Each element 18, 20 makes contact with the tube 10 over approximately one half of the axial length thereof. As can be seen in FIG. 4, the "angular extent" (i.e. the width) of each element 18, 20 is small relative to the circumference of tube 10, so that the elements 18, 20 contact the tube only along elongated zones in the form of strips, spaced through approximately 180° about the axis 12 of the tube.

The elements 18, 20 are joined at the proximal end by a mounting part in the form of a cross-piece 24 arranged approximately at right angles to the axis 12 of the tube. At their opposite distal ends, the elements 18, 20 converge (from their respective zones of contact with the tube 10) to a rounded apex 26 or guide part. As will be further described below, in use, the crosspiece 24 is secured to a suitable carrier so that the element 14 projects cantilever-fashion away from the carrier. The apex 26, at the free end of the cantilever-mounted support element 14, facilitates mounting of a tube on the element 14 by guiding the tube as the tube is pushed over the element 14 from the free end thereof.

Element 14 preferably provides a substantially rigid tube-receiving structure. The element can conveniently be cast from synthetic plastics material. In order to save weight, and material, the element is preferably made as thin as possible, subject to providing the required rigidity and strength. It may comprise a continuous stiffening/strengthening rib 28, an outer web portion 30 and an inner web portion 32 surrounding a central opening 34.

The clamping element 16 shown in FIG. 1 is formed separately from the tube supporting element 14. Element 16 has a mounting portion 36, adapted to be pressed between the rib 28 on crosspiece 24 of element 14 and the carrier, which is not illustrated in FIG. 1 but which will be described below. Rib 28 is formed with a groove to receive the mounting portion 36. In this way, element 16 is secured relative to element 14 with a resilient arm 38 projecting forwardly from the portion 36. As viewed in the direction of the arrow A in FIG. 1, arm 38 lies directly above portion 18 of element 14, and has approximately the same width. Arm 38 is integral with a curved contact portion 40 which in turn is integral with an extension 42, providing the outermost (free) end of the clamping element.

Arm 38 is flexible and forms a resilient bias means urging portion 40 towards the position illustrated in full lines in FIG. 1, in which the portion 40 engages portion 18 of tube support element 14. In this condition, extension 42 diverges from portion 18 forming a wedge-shaped space 44, into which the "leading" end of a tube 10 can easily be passed as the tube is pushed from left to right (as viewed in FIG. 1) over the supporting element 14. The leading end of the tube thus wedges extension 42, and hence contact portion 40, away from portion 18 against the resilient bias provided by arm 38. Eventually, contact portion 40 rides onto the outer surface of tube 10, and the latter can be pushed over the element 14 until its leading end engages the portion 36 of clamping element 16.

The tube 10 is then located against movement in directions at right angles to the axis 12 by engagement with both portions 18 and 20, as described above. Also, the tube is adequately retained against axial movement relative to the supporting element 14 by the resilient clamping force applied from the arm 38 via contact portion 40. This resilient clamping force can be adapted to provide a required resistance to removal of tube 10 from the element 14, the necessary resistance being determined on a case to case basis in dependence upon the accompanying circumstances. Furthermore, the length of each contact zone (strip) between portions 18 and 20 and the tube ensures that the axis of the latter has a substantially predetermined disposition relative to element 14 when fully mounted thereon. The tube cannot "wobble" to a significant degree relative to the support. These effects are, of course, subject to maintenance of reasonable tolerances in the interior diameter of tube 10.

FIG. 2 illustrates an alternative embodiment designed for use with a tapered bobbin tube, a longitudinal section of which is indicated in dotted lines at 46.

The longitudinal axis of this tube is indicated in chain-dotted lines at 48. Since the principles involved are exactly the same as in the first embodiment, the description of the second embodiment will be relatively brief. Similar reference numerals are used to refer to similar parts.

The bobbin tube supporting element is indicated at 14A and comprises portions 18A, 20A which are diametrically oppositely disposed relative to the axis 48. Each portion 18A, 20A engages the internal surface 15 of bobbin tube 46 along respective contact zones in the form of narrow strips. A clamping element 16A cooperates with the portion 18A in the manner previously described for the portions 16 and 18 in FIG. 1. The detailed structure of element 14A is similar to that of the element 14 in FIG. 1, comprising a strengthening rib 28, an outer web 30A, and an inner web 32A surrounding a central opening 34A.

A crosspiece 24A joins the portions 18A, 20A and enables mounting of the tube supporting element on a carrier, for example in the manner which will be described below with reference to FIG. 3. Rib 28 can have exactly the same form as the correspondingly referenced part in FIG. 1, adaptation to the tapered tube being effected by changing the shapes of the webs 30, 30A. Different angles of taper can be similarly accomodated.

In FIG. 3, the tube 46 is shown in full lines, and the portion of support element 14A within the tube 46 is indicated merely in outline, since it is not significant in relation to the aspects to be described with reference to FIG. 3. That figure shows a carrier in the form of an elongate metal bar 52 which is viewed in section in the figure and is of constant section along its length. Thus, bar 52 has a central, trough-like portion 54 adjoining respective wing-portions 56, 58, each of which has a turned-over free end portion 60, 62 respectively. In an assembled creel, or magazine, bar 52 carries a plurality of bobbin support devices which are spaced along the bar and arranged parallel to each other.

The crosspiece 24A of each element 14A has an integral boss 64 and the adjoining part of rib 28 is formed with a projecting foot 65 which fits into the trough-like portion 54 of the bar 52. Although it cannot be seen in FIG. 3, the crosspiece 24A has a through-bore extending through the center of the boss 64. A corresponding opening, also not shown, is provided in the base of trough-like portion 54, and a fixing bolt (shown at 67 in FIG. 5) is passed through the aligned openings to secure element 14A to the bar 52.

When the fixing bolt 67 is tightened up, crosspiece 24A engages the wings 56, 58 to either side of the trough-like portion 54. The crosspiece 24A has a pair of studs 66, projecting through corresponding openings in respective wings 56, 58 to resist any tendency for element 14A to turn about the longitudinal axis of its fixing bolt. Clamping element 16A is pressed between crosspiece 24A and the wing 58, and is provided with a suitable opening to receive the upper stud 66 as viewed in FIG. 3.

A carrier bar 52, with a group of bobbin tube supporting elements mounted thereon, can be secured in any desired fashion in a creel or magazine structure. In the preferred form, a bobbin tube magazine may comprise a chain conveyer, a part of which has been illustrated at 68 in FIG. 3. The chain conveyer may comprise a pair of parallel endless chains, one of which is partly illustrated at 68 in FIG. 3 and the other at 69 in FIG. 5. The bar 52 is mounted between the endless chains by securing the trough-like portion of the bar to one link of each chain; in the case of chain 68, bar 52 is secured to link 70 and in the case of chain 69 to link 72 (FIG. 5 only).

The diagram of a closed conveying path P shown in FIG. 3A indicates directions of movement. The path P is elongated and generally upright with non-illustrated drive and guide sprockets at the upper and lower ends of the path. Thus, the path comprises a generally vertical downward run DR and a generally parallel upward run UR. The illustrated portion of chain 68 in FIG. 3 will be assumed to lie on the downward run DR, while the illustration in FIG. 5 is assumed to lie on the upward run UR; i.e. in FIG. 3A, the chains are assumed to move from top to bottom of the figure, while in FIG. 5 the bar 52 is assumed to be approaching the observer. Links 70, 72 are so aligned that bar 52 extends substantially horizontally between the chains as it moves on each of the vertical conveyer runs DR, UR. The elements 14A (or 14 in the case of an embodiment according to FIG. 1) project substantially at right angles to the length of bar 52 and to the conveying direction.

As best seen in FIG. 5, each "mounting" link 70, 72 of each chain has a pair of outwardly projecting flanges 73. These engage the base of the trough-like portion 54 of the bar, and a fixing screw 75 is passed through each flange 73 and the bar 52. In FIG. 5, the bosses 64 and feet 65 of two elements 14A are indicated adjacent chain 68; three other support elements 14A are indicated only by the centre lines 77 of their fixing bolts. The bars 52 could be extended to either side of the chains 68, 69 and carry additional supports on the extensions if required.

Every second link of chain 68 is in the form of the mounting link 70 (and every second link of chain 69 is in the form of link 72). The intermediate or joining links 74 (FIG. 3) do not have flanges 73, but they have curved faces 78 directed towards the bars 52. The curved face 78 on the link 74 on one side of a link 70 is engaged by the turned-over portion 62 of the bar 52 mounted on that link, while the curved face 78 on the link 74 on the other side of the same link 70 is engaged by the turned-over portion 60 of the same bar 52. Thus, assuming that a respective bar 52 is mounted on each link 70, each face 78 is engaged by the turned-over portions 60, 62 of successive bars 52. This stiffens the structure comprising the chains 68, 69 and bars 52 on the vertical conveyer runs UR, DR, without interfering with the ability of the conveyer to turn around the path ends defined by the non-illustrated sprockets.

The retaining force exerted by a support on a tube mounted thereon must be at least sufficient to ensure that the tube remains held by the support as the latter moves around the lower sprocket (transfer from the downward to the upward vertical runs).

It will be seen from FIG. 3 that the axis 48 of tube 46 is not disposed at right angles to the "plane" of bar 52 as represented by the surface of the wings 56, 58 facing towards the tube. This small "tilt" of the tube relative to the bar, and the corresponding shaping of portions 18A and 20A relative to the crosspiece 24A, has a specific purpose in the magazine structure described in the copending U.S. patent application, namely that the front top edge E as viewed in FIG. 3 has a defined position for both cylindrical and conical tubes. However, this is not an essential feature of the bobbin tube supporting device as such. It will be understood that the support of FIG. 1 can be mounted in a similar manner, on an essentially similar carrier bar; in that case, the axis 12 of the tube 10 will in any event extend substantially at right angles to the "plane" of the carrier bar.

MODIFICATIONS

The bobbin tube supporting element may contact the interior of its tube at more than two locations. In principle, a peg corresponding in shape to the interior of the bobbin tube could be used, but this would be heavy (unless of hollow construction) and would not be as readily adaptable as the rib/web structure defined above. Alternatively, the element 14 shown in FIG. 1 could be provided with a star-shape as viewed in longitudinal cross section (at right angles to the plane of the drawing in FIG. 1). However, the important point is to prevent shifting of the mounted bobbin tube in directions transverse to its own axis, and the two diametrically opposed contact regions are adequate for this purpose while enabling a support element of low overall weight to be used. It is not essential to join the individual tube engaging portions at the forward ends, but some means is desirable to prevent mounting of tubes on "the wrong pair" of unjoined portions on a conveyer.

Similarly, a plurality of clamping elements could be provided outside the tube in alignment with respective internal contact locations.

The (or each) clamping element could be formed integrally with the support element provided adequate resilience can be obtained by this means. Furthermore, a clamping element could cooperate with the internal surface of the bobbin tube instead of the external surface. An embodiment incorporating this modification is shown in FIG. 6.

FIG. 6 shows a modified version of the supporting element shown in FIG. 1, i.e. arranged to receive a cylindrical bobbin tube indicated in dotted lines at 10. The support element 14B has a crosspiece 24B at one end for securing the element to a carrier (not shown), and an apex 26 at its other, free end. The element is of the generally "planar" type, as previously described with reference to FIGS. 1, 2 and 4, adapted to make contact with the internal surface of tube 10 on two, angularly limited zones diametrically opposed on the tube. For this purpose, element 14B has a portion 20B basically similar to the portion 20 shown in FIG. 1; there is in this case no outer web similar to the web portion 30 in FIG. 1, but this makes no difference in principle.

One strip-like region of contact with the tube 10 is formed by the portion 20B as already described for the portion 20 in FIG. 1. The diametrically opposite region of contact is formed by a resilient finger 76 which is integral with the portion 78 of the support element, but is joined to that portion only at the region 80. Finger 76 thus has a free end 82 near the crosspiece 24B. A gap 84 is left between finger 76 and portion 78, and the resilience of the finger enables it to flex from its illustrated ("normal") disposition to reduce the gap between itself and the portion 78. In the "normal" disposition of finger 76, the spacing L between the outer tip of free end 82 and the surface of portion 20B which contacts tube 10 is greater than the internal diameter D of the tube 10.

Accordingly, as the tube 10 is moved from left to right as viewed in FIG. 6 onto the element 14B, its leading end (to the right in FIG. 6) forces finger 76 downwardly as viewed in the figure into the gap 84. When the tube has been pushed to the maximum extent onto element 14B, finger 76 is flexed to an extent dependent upon the difference between the internal diameter D of tube 10 and the dimension L. The tendency of finger 76 to return to its normal disposition exerts a retaining force on both regions of contact between element 14B and tube 10, and this retaining force may be found sufficient dependent upon the circumstances of use. In general, this arrangement will be satisfactory for cylindrical bobbins, but may be found inadequate for use with conical bobbins.

In the arrangements described with reference to FIGS. 1 to 3, each bobbin support element has an associated individual clamping element 16 or 16A. This is not essential. A clamping element could, e.g., be made integral with the carrier bar 52 and could extend across the complete group of support elements mounted on the bar so as to cooperate with each of them. Alternatively, individual clamping elements could be formed by pressing tabs out of the carrier bar.

As indicated in the description, the arrangement is preferably such that the tube axis is disposed along a substantially predetermined line, or at least within a predetermined individual space relative to the conveyer. This requirement must be considered separately for two "regions" of the tube, namely the region which is either contacted or potentially contacted by the support element 14, 14A (in the embodiments as illustrated, the region to the right of the "shoulders" S of the support element), and the region which cannot be contacted by the support element. A further consideration is the tightness of fit of the tube on the support element.

In view of manufacturing tolerances and variation of dimensions with use (especially of tubes) some play between at least some tubes in a magazine and their respective support elements has to be anticipated. Thus, there will be some "wander" of the forward region of at least some tubes, that is of the tube regions spaced from the bars 52. In the illustrated embodiments, the shorter the contact strips or zones relative to the tube lengths, the greater the possible degree of wander. Acceptable limits will have to be established in dependance upon the circumstances, but it will almost always be undesirable to permit the forward region of a tube to wander so far that it can interfere with mounting of a tube on an adjacent support. At the same time, it will be desirable to obtain the optimal packing density of tubes in the loaded magazine.

It will be noted that it is not essential for this purpose to have continuous contact between a support and a tube over a length along the axis of the tube. It would be possible to obtain the required effect, say in FIG. 1, by contacting tube 10 at the shoulders S and at the fully inserted tube end, leaving the intervening portion without contact.

The support is not limited to use in a magazine or creel comprising a conveyer—the bars 52 can be fixedly mounted. In such a case, they can be simplified as they will not have to perform a stiffening function. Where a conveyor is used, it is not necessarily in the form of a chain; furthermore, the conveying path is not necessarily elongated, and where it is so, it is not necessarily upright.

The magazine or creel may be adapted to be fixed (e.g. as in U.S. Pat. No. 4,641,740 or mounted on a moving part (e.g. as in the prior applications referred to in the introduction to this specification), and as described in the copending U.S. patent application referred to above.

It will be recognised that in addition to providing improvements in bobbin tube supports as such, the invention also provides an improved form of bobbin tube magazine or creel. In general, such a magazine or creel comprises conveying means for conveying bobbin tubes around a closed conveying path. It further comprises a plurality of tube holding means each adapted to hold an individual bobbin tube relative to the conveying means during movement around said path. To this extent, the magazine or creel is similar to those disclosed in German published Patent Specification No. 2225673 and U.S. Pat. No. 4,641,740. The new magazine or creel differs from the known forms, however, in that each holding means is adapted to locate a tube held thereby against movements generally radially of the tube and to exert (on the tube) a retaining force directed substantially radially relative to the tube, thus releasably retaining the tube against axial movement relative to the holding means.

In the illustrated embodiments of this aspect of the invention, the holding means is in the form of a support having a portion extending into the interior of a tube held thereby. While this is the preferred form of holding means, it is not essential to the new magazine or creel. The holding means could, for example, altenatively comprise a resilient socket adapted to engage only the external surface of a tube held thereby, while exerting a resilient retaining action on the tube. For example, such a holding means could comprise a deformable ring of resilient synthetic plastics material having an internal diameter smaller than the external diameter of a tube to be received thereby and deformable as the tube is pushed into the resilient socket provided by the ring. Alternatively, a resilient receiving socket could be formed by a plurality of resilient elements such as metal or plastics leaf springs.

As already indicated, the important feature is location of each held tube during a conveying stage at which the tube is suspended from its holding means, for example during travel around the lower sprocket referred to in the description of FIG. 3. Since the tube does not fall away from its holding means at this stage of conveying movement, there is no necessity to provide guide means beneath the conveyor. In fact, there is no necessity to provide any housing or casing around the conveyor structure. A support frame must be provided to maintain the required conveyor configuration, but the tube receiving surfaces on the conveyor can be left exposed. This facilitates not only loading/unloading of the conveyor, but also inspection of the contents of the magazine/creel.

This aspect of the invention extends to a creel or magazine as shown in U.S. Pat. No. 4,461,740 with the addition of clamping elements to retain the tubes relative to the pegs; such clamping elements should clearly engage the external surfaces of the tubes at positions radially opposite the pegs.

The retaining effect should preferably be at least sufficient to prevent a tube moving relative to the support under its own weight when the tube is suspended from the support. A certain "safety margin" will be desirable, especially to allow for variation of tube wall thickness, but excessive retaining force will eventually damage the tube and should be avoided.

A retaining force in the range 1 to 3 Newtons will generally be adequate to maintain the tubes in place in the magazine, even as the tubes pass around the lower end of a vertically extending conveying path. This force must of course be overcome by the gripper in withdrawing a tube from the magazine.

What is claimed is:

1. A bobbin tube support comprising a tube supporting element having at least two longitudinally extending strip-like elements for contacting an interior of a bobbin tube at angularly spaced apart locations to prevent relative radial movement thereat, each said strip-like element having at least two longitudinally spaced sections for contacting the bobbin tube to maintain the tube on a predetermined axis, and a cross-piece connecting said strip-like elements at a proximal end of said supporting element; and a resilient retaining element extending over one of said strip-like elements and secured to said cross-piece to apply a clamping force on a bobbin tube located between said retaining element and said tube supporting element for releasably retaining the tube against axial movement from said supporting element.

2. A bobbin tube support as set forth in claim 1 wherein said strip-like elements of said supporting element are oppositely disposed to be spaced 180° degrees apart relative to a received bobbin tube.

3. A bobbin tube support as set forth in claim 2 wherein each strip-like element has a length of from one third to one half the length of a received tube.

4. A bobbin tube support as set forth in claim 2 wherein said supporting element includes a guide part connecting said portions at a distal end thereof for guiding of a bobbin tube thereon.

5. In combination a carrier;

a plurality of tube supporting elements mounted on said carrier in cantilever fashion, each said element having at least two longitudinally extending strip-like elements for contacting an interior of a bobbin tube at angularly spaced apart locations to prevent relative radial movement thereat and a cross-piece connecting said strip-like elements at a proximal end of said supporting element; and at least one resilient retaining element extending over at least one supporting element and secured to a cross-piece thereof to apply a clamping force on a bobbin tube located between said retaining element and said supporting element for releasably retaining the tube against axial movement from said supporting element.

6. The combination as set forth in claim 5 which includes a plurality of said retaining elements, each said retaining element being disposed adjacent a respective supporting element and secured thereto.

7. A bobbin tube creel comprising conveying means for conveying a plurality of bobbin tubes in an endless path having a vertically disposed portion;

a plurality of tube supporting elements mounted on said conveying means for movement along said path, each element being disposed in a vertical plane in said vertically disposed portion of said conveying means and having strip-like elements thereon for exerting a retaining force directed radially of a received bobbin tube to retain the tube against an axial movement relative to said strip-like elements and a cross-piece connecting said strip-like elements at a proximal end of said supporting element and a resilient retaining element extending over at least one of said strip-like elements of a respective supporting element to clamp a received bobbin tube therebetween.

8. A bobbin tube supporting element comprising at least a pair of elongated strip-like elements for contacting an interior of a bobbin tube at angularly spaced apart locations to prevent relative radial movement thereat;

a cross-piece connecting said elements at proximal ends thereof for mounting of said elements from a carrier in cantilever-fashion;

a guide part connecting said elements at distal ends thereof for guiding of a bobbin tube onto said element; and a foot projecting from said cross-piece for mounting in a carrier.

9. A bobbin tube supporting element as set forth in claim 8 which further comprises means for securing said foot to a carrier.

10. A bobbin tube supporting element as set forth in claim 8 wherein said guide part forms a rounded apex.

11. A bobbin tube supporting element as set forth in claim 8 wherein each strip-like element includes a narrow rib and an integral inner web defining an opening therebetween.

12. A bobbin tube supporting element as set forth in claim 11 which further comprises an integral outer web extending from one of said strip-like elements for engaging a received bobbin tube.

13. A creel as set forth in claim 7 wherein said conveying means includes a pair of chains disposed in said endless path and a plurality of parallel bars secured to said chains, each said bar having a plurality of said tube supporting elements thereon.

14. A creel as set forth in claim 13 wherein each chain has a plurality of links, each respective bar being secured to and one of said links and having a turned-over end portion engaging a curved face of an adjacent link to stiffen said conveying means.

15. A bobbin tube supporting element comprising a pair of oppositely disposed strip-like elements for positioning within an interior of a bobbin tube and an integral resilient finger extending outwardly from one of said elements in a proximal direction for resiliently engaging a bobbin tube thereon;

a cross piece connecting said elements at proximal ends thereof for mounting of said elements from a carrier in cantilever-fashion; and a guide part connecting said elements at distal ends thereof for guiding a bobbin tube onto said elements.

* * * * *

UNITED STATES PATENT AND TRADEMARK OFFICE

CERTIFICATE OF CORRECTION

PATENT NO. : 4,781,338

DATED : Nov. 1, 1988

INVENTOR(S) : Andre Lattion

It is certified that error appears in the above-identified patent and that said Letters Patent is hereby corrected as shown below:

Column 1, line 37, "employes" should be --employs--.

Column 3, line 8, "found from in" should be --found in--.

Column 3, line 24, "diagramatic" should be --diagrammatic--.

Column 5, lines 20 and 21, "accomodated" should be --accommodated--.

Column 9, line 21, "altenatively" should be --alternatively--.

Column 12, line 10 "to and one" should be --to one--.

Signed and Sealed this

Second Day of May, 1989

*Attest:*

DONALD J. QUIGG

*Attesting Officer*

*Commissioner of Patents and Trademarks*